US005596972A

United States Patent [19]

Sultan et al.

[11] Patent Number: 5,596,972

[45] Date of Patent: Jan. 28, 1997

[54] INTEGRATED FUELING CONTROL

[75] Inventors: Myrna C. Sultan; Charles H. Folkerts, both of Troy; Gregory P. Matthews, West Bloomfield; Mark D. Kushion, Saginaw, all of Mich.

[73] Assignee: General Motors Corporation, Detroit, Mich.

[21] Appl. No.: 558,600

[22] Filed: Oct. 30, 1995

[51] Int. Cl.[6] ..... F02M 33/02

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 4,748,959 | 7/1988 | Cook et al. | 123/520 |
| 5,178,117 | 1/1993 | Fujimoto et al. | 123/520 |
| 5,188,085 | 2/1993 | Habaguchi et al. | 123/520 |
| 5,216,995 | 6/1993 | Hosoda et al. | 123/520 |
| 5,224,456 | 7/1993 | Hosoda et al. | 123/520 |
| 5,329,909 | 7/1994 | Hosoda et al. | 123/520 |
| 5,343,760 | 9/1994 | Sultan et al. | 73/861.04 |
| 5,373,822 | 12/1994 | Thompson | 123/520 |

OTHER PUBLICATIONS

Research Disclosure—29874 Vapor Purge System –Feb. 1989.

Research Disclosure—36205—Charcoal Canister Purge (CCP) Valve Diagnosis Using a Vacuum Sensing Device–Jun. 1994.

*Primary Examiner*—Thomas N. Moulis

*Attorney, Agent, or Firm*—Michael J. Bridges

[57] ABSTRACT

Integrated control of internal combustion engine fueling including control of fuel injectors and control of purge valve position to vary the rate at which fuel vapor trapped in a canister is purged to an engine intake manifold, determines the mass of purge vapor reaching the intake manifold, estimates the mass of purge vapor reaching each engine cylinder, and adjusts the engine cylinder fuel injection mass in response thereto to provide an accurate overall cylinder fueling insensitive to the purge rate, allowing the purge control operations to be aggressively driven while ambitious cylinder air/fuel ratio standards are maintained. Feedforward purge control proactively adjusts purge control commands in response to desired cylinder purge mass and to purge vapor flow dynamics and feedback purge control trims the purge control commands in response to a difference between the desired cylinder purge mass and estimated cylinder purge mass.

8 Claims, 4 Drawing Sheets

INTEGRATED FUELING CONTROL

FIELD OF THE INVENTION

This invention relates to automotive internal combustion engine fueling control and, more particularly, to engine fuel delivery control integrating control of canister purge and control of cylinder fuel injection.

BACKGROUND OF THE INVENTION

Automotive evaporative emissions control systems are known in which fuel vapor from a fuel supply are trapped in a charcoal canister so as to not be released to the atmosphere. Fuel vapors can be rapidly generated under severe automotive vehicle operating conditions. The canister should be maintained in a condition providing for capture of even rapidly generated fuel vapors by periodically purging the vapors trapped therein. Canister purge may be provided by applying engine intake manifold vacuum to the canister to draw the trapped vapor out of the canister and into the engine intake manifold where it is combined with engine intake air. The purged vapor has a significant effect on engine air/fuel ratio, and can perturb air/fuel ratio away from a desirable ratio, reducing engine performance and increasing engine emissions. Accordingly, it has been proposed to control the purge rate by positioning a purge valve in the vapor conduit between the engine intake manifold and the canister and controlling the valve position. It has further been proposed to reduce the purge rate when the purge vapor may be influencing negatively engine air/fuel ratio. For example, the engine air/fuel ratio may be determined as a function of the oxygen content in engine exhaust gas. If the determined air/fuel ratio deviates appreciably away from a desired air/fuel ratio, purge rate may be adjusted. Accordingly, maintenance of the canister can be compromised by other engine control operations. Further, the correction in purge rate is only made reactively, after the air/fuel ratio deviation and the corresponding emissions and performance penalties have been incurred. Under conditions in which purge rate, engine intake air rate, or engine fueling rate change rapidly, repeated deviations in air/fuel ratio may result from such reactive engine air/fuel ratio control.

The concentration and flow of purge vapor can vary significantly. A single purge valve position command can be associated with a wide range of actual delivered purge fuel vapor mass to the engine cylinders. To provide for precision control of the purge mass actually reaching the engine, it has been proposed to estimate the purge vapor flow passing between the canister and the engine based on a measurement of vapor concentration, and to adjust purge valve position in response thereto. However, vapor flow rate is dependent on vapor concentration and can vary significantly depending on variation in flow restrictiveness and during engine transient maneuvers. Estimates of purge flow rate fail to account for such factors as varying restrictiveness of the purge line, and certain transient conditions. Further, the mass of fuel vapor reaching the engine, such as the engine intake manifold, may not correspond exactly to the mass of fuel vapor actually reaching the engine cylinders due, for example, to vapor transport dynamics in the engine. As a result, the mass of purge vapor entering engine cylinders can only roughly be approximated. If aggressive purge control is desired, an engine air/fuel ratio control penalty must then be paid. As described, closed-loop engine air/fuel ratio control relying on exhaust gas oxygen sensor information may relieve this penalty under certain operating conditions. But if precise engine air/fuel ratio control is required under all engine operating conditions, maintenance of the canister may be compromised by reducing purge rate below that required to provide a canister with sufficient reserve capacity. Such compromise can increase system susceptibility to vapor release to the atmosphere. It has further been proposed to vary purge rate as a function of engine intake mass airflow rate, which again can compromise canister maintenance, for example, by reducing purge rate below a desired rate in response to changes in engine intake mass airflow rate. Accordingly, current purge control proposals suffer shortcomings in purge control accuracy, canister maintenance, and engine air/fuel ratio control accuracy.

It would therefore be desirable to determine the precise mass of purge fuel vapor entering individual engine cylinders, to correct the purge command in response thereto, and to provide for cylinder fuel injection in response to the determined vapor mass entering the cylinders so that accurate engine air/fuel ratio control under all operating conditions need not be compromised by the purge control operations necessary to maintain a canister capable of trapping vapors produced under even severe operating conditions.

SUMMARY OF THE INVENTION

The present invention provides a desirable integrated engine fueling control wherein a precise measure of the mass of fuel vapor entering each engine cylinder is determined, the purge rate is adjusted in response thereto, and engine fuel injector control is proactively adjusted in response to the precisely measured vapor mass to maintain accurate purge rate control to an uncompromised desired purge command without perturbing engine air/fuel ratio away from a desired ratio.

More specifically, purge vapor concentration and pressure are directly measured at or near the engine, and the mass rate of purge fuel vapor determined as a function thereof. A fuel injector pulse width reduction is determined as a function of the mass rate so that the total delivered fuel quantity to the cylinder is precisely that necessary for accurate air/fuel ratio control. In accord with a further aspect of this invention, vapor transport dynamics between the engine intake manifold and individual engine cylinders are modeled and the model applied to the determined mass rate of purge fuel entering the engine to estimate the flow to individual engine cylinders. The cylinder fuel injection command is then reduced by the determined mass rate of purge fuel entering the corresponding cylinder. In accord with a further aspect of this invention, the mass rate of purge fuel is fed back to a closed-loop control which adjusts the purge rate command applied to the purge valve to drive the actual mass rate controllably toward the desired rate. In accord with yet a further aspect of this invention, a feedforward control responsive to vapor concentration and purge pressure and temperature adjusts the purge valve command to that command necessary to provide a desired purge mass to the engine in a feedforward arrangement, to proactively account for vapor flow rate, vapor transport dynamics and concentration variations.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
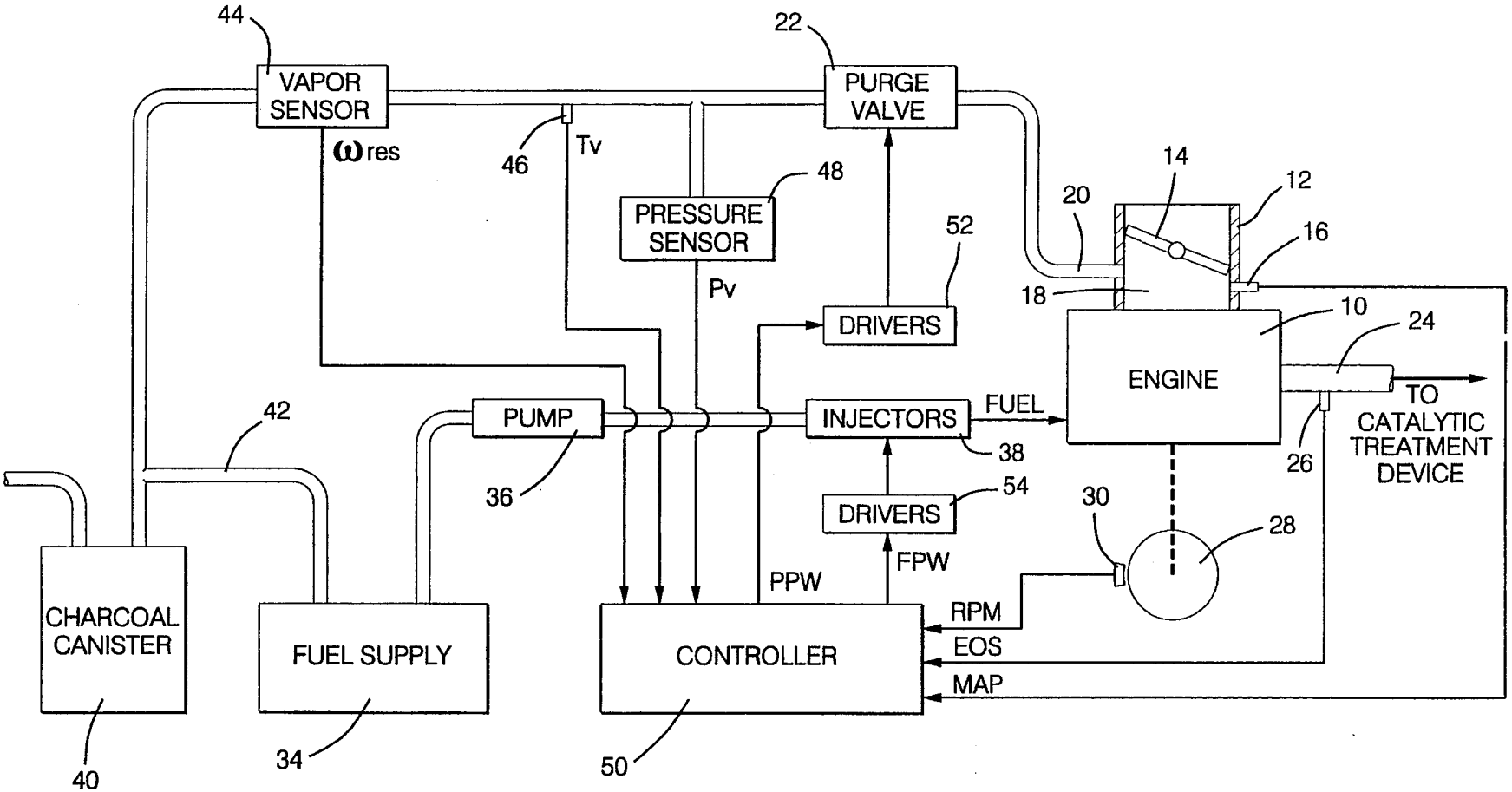
FIG. 1 is a schematic of the integrated fuel control hardware of the preferred embodiment of this invention.

Referring to FIG. 1, internal combustion engine 10 receives intake air through intake air bore 12 in which is disposed intake air valve 14, such as a conventional throttle valve for restricting passage of intake air through the intake air bore 12 to intake manifold 18 downstream of intake air valve. Intake manifold absolute air pressure is transduced by pressure transducer 16 into output signal MAP. Engine fuel pump 36 draws fuel from fuel supply 34 and provides pressurized fuel to at least one conventional fuel injector 38 which is electronically controlled to meter fuel to engine cylinder intake passages (not shown).

Fuel vapor evaporating from the fuel supply 34 is guided through vapor conduit 42 which opens into conventional high efficiency charcoal canister 40 in which the vapor is maintained. Purge conduit 20 is provided between intake manifold 18 and the canister 40. Purge valve 22, such as a conventional electronically controlled solenoid valve, is disposed in the purge conduit 20. When the valve 22 is electrically driven to an open position, the canister 40 is exposed to intake manifold vacuum, drawing trapped fuel vapors out of the canister 40, through the conduit 20 and into intake manifold 18 for mixing with intake air and distribution via the manifold 18 to engine cylinder intake passages (not shown) where the mixture of intake air and purged vapor is further combined with injected fuel for admission to engine cylinders (not shown). The inventors intend that any precision vapor control valve mechanization may be provided in conduit 20 for controlling the passage of purge vapor to the engine intake manifold 18, including linear precision solenoid valves, and solenoid valves placed in parallel vapor paths, both of which parallel paths are open to the intake manifold 18 on a first end and are open to the vapor passing out of the canister 40 on a second end opposing the first end. A mass airflow sensor (not shown) of a conventional design, such as a commercially-available thick film or hot wire type mass airflow sensor, may be provided in intake air bore 12 for transducing the mass of intake air passing thereby into sensor output signal MAF.

The concentration of the fuel vapor is transduced by acoustic vapor concentration sensor 44, such as an acoustic vapor concentration sensor corresponding to the sensor described in U.S. Pat. No. 5,343,760, assigned to the assignee of this application, and hereby incorporated herein by reference. The sensor 44 is positioned in the conduit 20 in proximity to the engine 10 so that the concentration information provided thereby most closely represents the concentration of vapor entering the engine intake manifold 18. Generally, the resonant frequency of the sensor 44 is dependent on the concentration of the particular vapor resident therein. The purged vapor is passed through a sense chamber of the sensor 44 and the resonant frequency $\omega res$ determined by the sensor signal processing approach as described in the incorporated reference. The resonant frequency is communicated as the sensor output signal $\omega res$, so that the vapor concentration may be determined as a function of $\omega res$, such as by applying the determined frequency to the equation (8) of the incorporated reference, to yield fuel vapor concentration information. In addition to the concentration, an estimate of the purge flow rate through the purge conduit 20 is required, for accurate integrated engine fueling control, as provided for in accord with this invention. Accordingly, pressure transducer 48, such as a conventional pressure transducer generally known in the art, is provided in conduit 20 for transducing vapor pressure passing through the conduit 20 into output signal Pv. In an alternative embodiment of this invention, a flow sensor is provided in conduit 20 to measure purge flow rate directly.

The mixture of injected fuel, purged vapor and intake air is admitted to engine cylinders for combustion therein, for rotating at least one engine output shaft, such as crankshaft 28, having a series of teeth or notches circumferentially disposed about the shaft. A conventional Hall effect or variable reluctance sensor 30 is positioned so the teeth or notches of the crankshaft 28 pass the sensor as the shaft rotates with sufficient proximity to the sensor to measurably disrupt the sensor magnetic field. The disruptions may be transduced into sensor output signals variations provided as analog signal RPM, which indicates the rate of rotation and relative position of the crankshaft 28. The frequency of signal RPM is proportional to the rate of rotation of the crankshaft (which is also referred to herein as engine speed). For an N cylinder, four stroke engine, an engine cylinder event will be detected from the signal RPM for every 720/N degrees of crankshaft rotation, and a cylinder event interrupt will be generated indicating the cylinder event. The engine cylinder combustion products are exhausted out of engine 10 via exhaust gas conduit 24 in which is disposed at least one zirconia oxide sensor 26 for sensing exhaust gas oxygen content, and for outputting signal EOS indicating the exhaust gas oxygen content. Temperature transducer 46, such as a conventional thermistor or thermocouple is provided in conduit 20 at a suitable location near the engine 10 to indicate the temperature of vapor passing through conduit 20 and being substantially insensitive to temperature from other sources. The transducer outputs signal Tv indicating purge vapor temperature.

Controller 50, such as a conventional sixteen bit microcontroller of a suitable, commercially available design is provided including such generally known elements as a central processing unit, read only memory unit, random access memory unit, and input/output unit. The controller 50 receives input signals from sensors, including signals $\omega res$, Pv, Tv, RPM, EOS, and MAP, and, through execution of a series of controller operations, issues a series of control, diagnostic, and maintenance signals, including actuator commands and indicator excitation signals, for carrying out general engine control operations. Such operations include, in accord with this invention, operations for providing an integrated control of engine fueling including control of purge fuel vapor delivery coordinated with control of engine fuel injectors.

More specifically, controller 50 issues purge control pulse width command PPW to purge valve driver 52 such as a conventional current control circuit for driving the solenoid of purge valve 22 at the duty cycle specified by a command Pdc, to be described, for precise control of the amount of fuel vapor delivered to the engine intake manifold 18. Additionally, fuel injector drive command FPW is output by controller 50 to fuel injector driver 54 of any conventional design to issue a timed injector drive current signal to control the time of opening of individual injectors when such injectors are to be activated to fuel respective engine cylinders as is generally understood in the art. The injectors are positioned to deliver the fuel quantity to the engine intake air passages (not shown) to be combined with the purge fuel vapor quantity and mixed with engine intake air metered by intake air valve 14, the combination for delivery to engine cylinders. A precise engine cylinder air/fuel ratio is provided through the approach of this invention without compromising efficient and aggressive purge scheduling, resolving the need for maximum purging of trapped fuel vapors under extreme driving conditions and the need for precise engine cylinder air/fuel ratio for maximum engine emissions treatment efficiency and engine performance, as is generally understood in the art.

Figure 2:
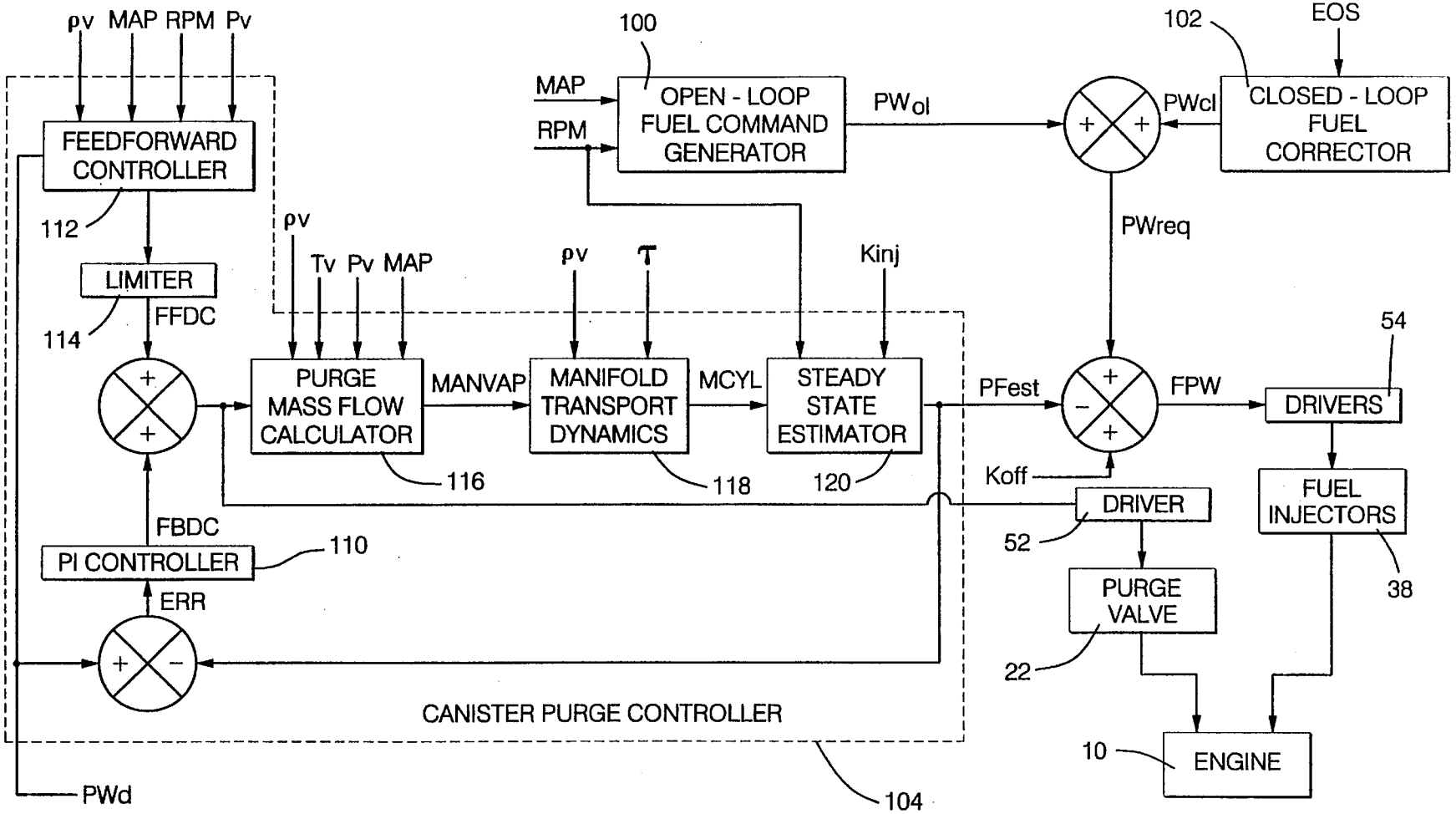
FIG. 2 is a control diagram illustrating the control process of the preferred embodiment.

A control structure for carrying out such integrated fueling control is diagrammed in FIG. 2. The structure includes a canister purge controller 104 for generating purge valve commands using feedforward and feedback controllers and for estimating the actual mass of purge vapor reaching individual engine cylinders expressed, for convenience in this embodiment, as an equivalent fuel injector pulse width. The structure further includes a fuel injector command generator 100 and corrector 102 and provides for a fuel injector command reduction to account for the measured fuel vapor quantity reaching individual engine cylinders. FIGS. 3–7 provide specific details of the control functions diagrammed in FIG. 2.

Referring specifically to FIG. 2, a desired purge pulse width PWd(k) for the current "kth" sampling event, for driving the purge valve 22, is provided from a schedule of pulse widths stored in controller read only memory as a function of current engine operating conditions, such as indicated by engine speed, engine load, engine temperature, purge vapor concentration, or as a dynamic function of time. Pwd(k+1) is also predicted as a desired purge pulse width at the next sampling event by predicting engine operating conditions such as intake manifold pressure and engine speed at the next sampling event, for example as described in U.S. Pat. No. 5,094,213, assigned to the assignee of this application. The desired pulse width may be referenced, for example, from a stored schedule of pulse widths as a function of the predicted engine operating conditions. PWd(k) and PWd(k+1) are expressed as pulse widths representing the equivalent fuel injector pulse width required to deliver such an amount of fuel to the engine. Such units of pulse width provide for correlation of the desired purge with fuel injector commands for the purpose of the integrated fueling control of this embodiment. PWd(k) and PWd(k+1) are provided to feedforward controller 112 for determining a feedforward purge duty cycle command as a function of vapor concentration ρv, and signals MAP, RPM, and Pv. The feedforward purge duty cycle command is limited to a predetermined upper limit value corresponding to a maximum open position of the solenoid by limiter 114.

An estimate of actual purge provided to the engine, also expressed as an equivalent to an injector pulse width command, to be described, is subtracted from PWd to form purge pulse width error ERR, which is applied to feedback controller 110, such as of a proportional-plus-integral design for driving ERR controllably toward zero. The PI controller 110 issues control command duty cycle FBDC to be summed with the output FFDC of feedforward controller 112 and limiter 114, forming purge valve command signal Pdc, in the form of a duty cycle command at which to open the purge valve 22 of FIG. 1 for precision vapor control in accord with this invention. The command Pdc is applied to purge valve driver 52 and is also applied to purge mass flow calculator 116 for calculating MANVAP, the mass flow rate of fuel vapor being purged into the engine intake manifold, as a function of Tv, Pv, MAP, ρv, and Pdc. MANVAP is then applied to an intake manifold transport dynamics model 118, to be described, to determine MCYL, the mass flow rate of vapor passing from the intake manifold to the engine cylinders, as a function of MANVAP, manifold filling constant τ, and vapor concentration ρv. MCYL is applied to steady state estimator 120 for estimating PFest, the mass of vapor trapped in an individual cylinder expressed, for convenience, as an equivalent fuel injector pulse width. The steady state estimator 120 relies on engine speed RPM and a slope of a fuel injector characteristic curve, Kinj. As described, PFest is fed back as an estimate of actual cylinder fuel vapor mass to feedback controller 110 for closed-loop correction of the purge duty cycle command.

Open loop fuel command generator 100 receives input signals including MAP and RPM and generates an open loop fuel command PWol, in the form of an injector pulse width command, such as may be generated from a calibrated relationship between engine cylinder intake air mass and desired engine cylinder air/fuel ratio. Cylinder intake air mass may be determined using MAP and RPM in a conventional speed density approach or may be measured using a mass airflow sensor across the engine intake air bore 12 (FIG. 1). Further, in this embodiment, cylinder intake air mass may be calculated through a model-based approach, such as that detailed in U.S. Pat. Nos. 5,423,208, 5,293,553, or 5,094,213, assigned to the assignee of this application. The desired air/fuel ratio may be the stoichiometric ratio. Closed-loop fuel corrector 102 receives signal EOS and determines, through any standard closed-loop fuel control technique, such as that described in U.S. Pat. No. 4,625,698, assigned to the assignee of this application, a signed, closed-loop correction pulse width PWcl, to be combined with PWol to form a required engine cylinder fuel pulse width PWreq, representing the amount of fuel required in the engine cylinder to provide for a desired cylinder air/fuel ratio. PWreq is reduced by the injector pulse width represented by PFest, in accord with an important aspect of this invention, to provide for the desired cylinder air/fuel ratio without compromising the desired purge schedule. An injector offset Koff, obtained from the fuel injector mass of fuel per cylinder versus base pulse width characteristic, is added to the difference between PWreq and PFest to form the injector command FPW, which is provided in the form of a pulse width for application to fuel injector driver 54 for producing a timed injector drive signal applied to one of the injectors 38 corresponding to the next cylinder of engine 10 to be fueled, as is generally understood in the art.

The series of operations for carrying out the integrated fueling control of this embodiment represented by the control structure of FIG. 2 and using the hardware of FIG. 1 are illustrated in FIGS. 3–7. Such operations may be periodically carried out in a step by step manner by controller 50 together with the hardware elements of FIG. 1, while the engine is operating. For example, following each engine cylinder event in which an engine cylinder undergoes a combustion event, or, in an alternative embodiment of this invention, following passage of a predetermined period of time, such as about 12.5 milliseconds, a standard controller interrupt is generated, suspending any ongoing controller operations so that a series of stored interrupt service operations may be carried out. The last of such operations include operations to reset the cylinder event or timer interrupt to recur at the time of the next cylinder event or timer period, and operations to resume carrying out of any suspended operations. The interrupt service operations may include standard engine intake air control and spark timing control operations, and standard diagnostic and maintenance operations. The interrupt service operations of this embodiment further include the integrated fueling control operations generally illustrated in FIGS. 3–7, which may be initiated following completion of any other operations required to be carried out during the servicing of the interrupt in accord with conventional engine control principles.

Specifically, the fueling control operations are initiated at a step 146 and then proceed to a step 148 at which input signals including signals MAP, MAF (if provided), RPM, Tv, Pv, and ωres are sampled for use in the integrated fuel control operations of this embodiment. Fuel vapor concentration ρv is next determined at a step 150 by applying the sample of signal ωres to a stored function representing the relationship between ωres and ρv, for example as illustrated by equation (8) of the above-incorporated U.S. Pat. No. 5,343,760. Alternatively, the function itself may not be stored, but rather a conventional lookup table may be stored in a memory device as a schedule of ρv values each of which are stored as a function of a corresponding ωres value. Standard interpolation procedures may then be used to reference a current concentration value corresponding to a current ωres value.

Desired purge pulse width Pwd(k) for the current ("kth") sampling event is next referenced at a step 152 from a stored schedule of pulse widths as a function of engine operating conditions such as engine speed, intake air rate, purge vapor concentration, or as a dynamic function of time, as described. Further, the desired purge pulse width at the next ("k+1"th) sampling event is predicted at the step 152 by predicting engine operating conditions such as engine intake manifold absolute pressure and engine speed at the next sampling event, as described for example in U.S. Pat. No. 5,094,213 and by referencing the desired purge pulse width from a stored calibrated schedule of pulse widths as a function of the predicted engine operating conditions, as described. The desired purge fuel pulse width may further be limited to a range of values to ensure a fuel injector pulse width command resulting therefrom does not drive a fuel injector into non-linear operation, such as is generally known in the art to occur with commercial injectors driven at extremely low or extremely high injection pulse widths.

Figure 4:
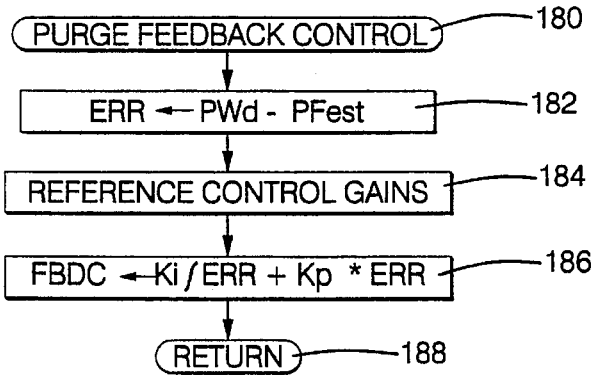

A purge feedback control routine is next initiated at a step 154 by proceeding to carry out the step by step operations of the routine of FIG. 4, beginning at a step 180 and proceeding to generate an error term ERR at a next step 182 as a difference between PWd and PFest, wherein PFest is the estimated cylinder purge mass expressed as an equivalent fuel injector pulse width, as described. Control gains are next referenced at a step 184 from controller memory, such as read only memory. The control gains may be determined through a conventional calibration process and may be stored in the form of a lookup table as a function of the engine operating condition. The gains may correspond to the design of the feedback controller 110 of FIG. 2, which is a PI controller in this embodiment but which may be any generally known controller design such as a design incorporating other classical control functions or incorporating state space or other modern control methods. The gains of this embodiment include a proportional gain Kp and an integral gain Ki, which are calibration constants.

A feedback duty cycle command FBDC is next generated at a step 186 through the PI control law of the feedback controller 110 of FIG. 2 as follows $$FBDC = Ki * \int ERR + Kp * ERR.$$

Figure 3:
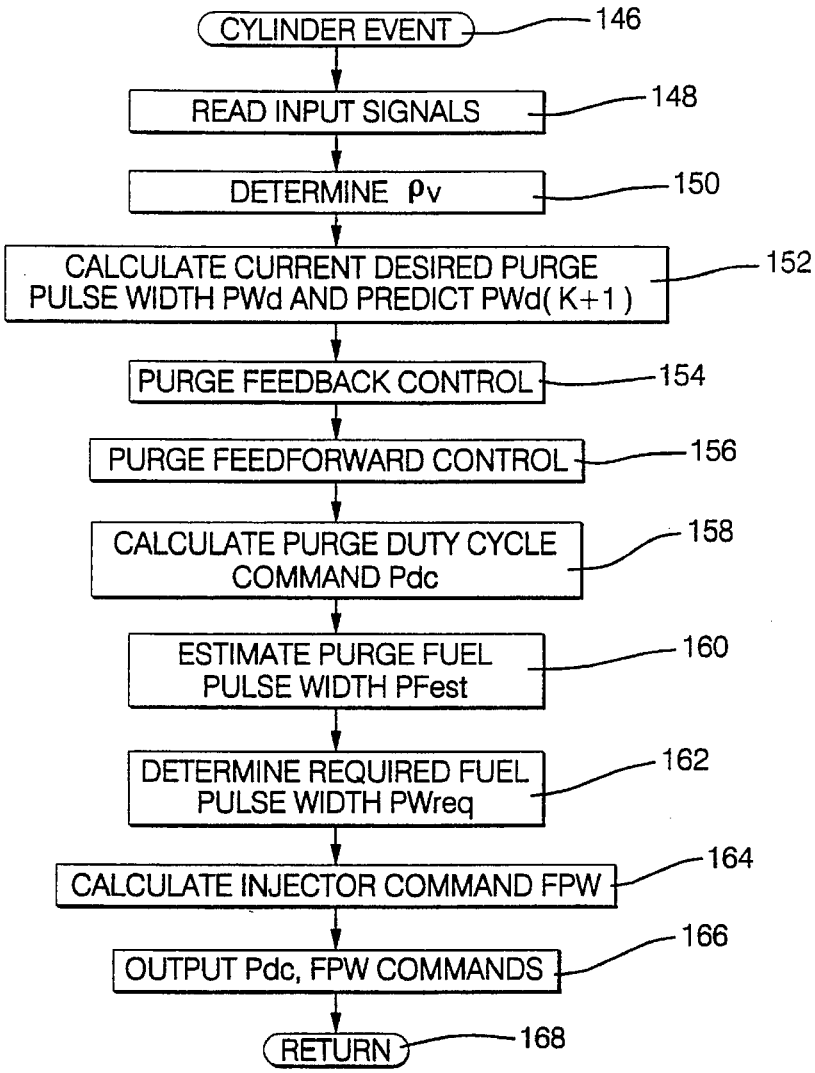
FIGS. 3–7 are diagrams illustrating a flow of operations for carrying out the integrated fuel control for the hardware of FIG. 1.
Figure 5:
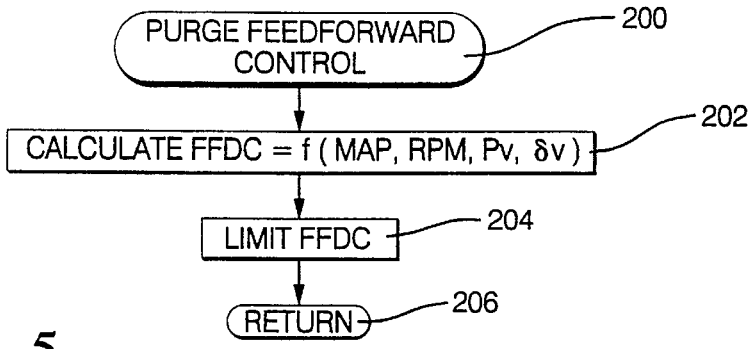

The routine then returns, via a next step 188, to execute a next step 156 of the routine of FIG. 3, at which feedforward control operations are provided by proceeding to the operations of FIG. 5. The feedforward operations are provided to proactively control the flow of the fuel vapors through conduit 20 in response to vapor concentration, pressure information and vapor transport dynamics, by determining the purge duty cycle needed to provide for the desired purge mass represented by PWd to reach the individual engine cylinders. Bernoulli's orifice equation and flow dynamics principles at critical flow are applied in the determination of the required purge duty cycle FFDC. Specifically, in this embodiment, such calculations are provided through the operations of FIG. 5 beginning at a step 200 and proceeding to a next step 202 at which a feedforward duty cycle command FFDC is determined as follows:

$$FFDC(k) = 1/K_s * (F * (PWd(k+1) - e^{-\Delta t/\tau} * PWd(k)) ) - K_{int}$$

in which $K_s$ and $K_{int}$ are determined as calibration constants for describing the relationship between mass airflow $m_{asol}$ through the purge valve 22 (FIG. 1) and purge duty cycle pdc at critical flow, as follows $$m_{asol} = K_s * pdc + K_{int.}$$

Further, PWd(k+1) is the desired predicted purge pulse width for the next pulse width determination (at the next sample), Δt is the sampling period between determined pulse widths (the algorithm sampling period), τ is a measurable time constant for engine intake manifold filling assuming a first order transport model, although conventional higher order models may be included within the scope of this invention. PWd(k+1) may be initialized to an initial value assigned to PWd(k) under an assumption that predicted desired purge pulse width at the next sampling event is equal to the desired purge pulse width at the current sampling event for an initial sampling event. The function F is given by $$F = \frac{\text{RPM} * N * K_{inj} * P_{aup} * (RT_v)^{1/2}}{120 * \rho_v * \psi * K_{area} * P_v * (1 - e^{\Delta t/\tau})}$$

in which N is the number of cylinders of the engine 10, $K_{inj}$ is the slope of the curve representing injector mass of fuel as a function of injector pulse width, such as about 3.23 grams/second for the injectors 38 of this embodiment, $P_{aup}$ is a test upstream pressure measured by the pressure transducer 48 (FIG. 1) during a purge valve flow mapping procedure with only air passing through conduit 20 (FIG. 1) and with the pressure drop across the purge valve 22 (FIG. 1) maintained at critical flow, constant R is expressed as $$R = R_o / M$$

in which $R_o$ is the generally-known universal gas constant, and M is the molecular weight of the purged mixture which may be expressed as $$M = \rho_v * M_b + (1 - \rho_v) * M_{a,}$$

in which $\rho_v$ is the measured concentration of fuel vapors in the purge vapor, $M_b$ is the known molecular weight of the fuel and $M_a$ is the known molecular weight of air. Further, $T_p$ is sensed air temperature during the purge valve flow mapping procedure, and $K_{area}$ is expressed as $$K_{area} = \frac{(R_o * T_p / M_a)^{1/2}}{(\gamma_a * (2/\gamma_a + 1)^{(\gamma_a + 1/\gamma_a - 1)})^{1/2}},$$

in which $\gamma_a$ is the ratio of specific heats of air, and is given by cpa/cva, wherein cpa is the specific heat of air at constant pressure and cva is the specific heat of air at constant volume. Still further, $\psi$ is expressed as:

$$\psi=(2*\gamma/(\gamma-1))^{1/2}*[(MAP/Pv)^{2/\gamma}-(MAP/Pv)^{(\gamma+1)/\gamma}]^{1/2}, \text{ for } MAP/PV>Pc$$

and $$\psi=[\gamma*(2/(\gamma+1))^{(\gamma+1)/(\gamma-1)}]^{1/2}, \text{ for } MAP/PV\leqq Pc,$$

wherein Pc is a critical pressure and is given by $$Pc=[2/(\gamma+1)]^{\gamma/(\gamma-1)}$$

in which $\gamma$ is given by $c_p/c_v$ wherein $c_p$ is the specific heat of the vapor at constant pressure and $c_v$ is the specific heat of the vapor at constant volume. The calculated FFDC is next limited to a maximum value, such as a value of 100 percent duty cycle, at a step 204, as described.

After limiting the purge duty cycle, the routine of FIG. 5 executes a step 206 to return to the operations of FIG. 3, at which a next step 158 is executed to calculate a purge duty cycle command Pdc as a sum of the determined FFDC and FBDC commands.

A purge fuel pulse width PFest is next estimated at a step 160, by initiating the operations of the routine of FIG. 6, beginning at a step 220 and proceeding to calculate the mass flow rate mp of the total purge flow into the engine at a next step 222 as follows:

$$mp=A_{peff}*Pv*\psi/(R*T_v)^{1/2}$$

in which $A_{peff}$ is the effective flow area across the purge valve 22 (FIG. 1) being driven at a specific duty cycle, which may be determined using a solenoid flow mapping at critical flow. For example, with air flowing across the valve 22 and the pressure ratio across the solenoid maintained at a critical flow, the mass airflow may be measured at different duty cycles. The mass airflow $m_{asol}$ as a function of percent duty cycle pdc is approximately linear and is given by:

$$m_{asol}=K_s*pdc+K_{int}$$

and therefore $A_{peff}$ may be calculated as follows $$A_{peff}=(m_{asol}/P_{aup})*Karea.$$

Once the mass flow rate of the total purge flow into the engine is determined, the mass flow rate of the purged fuel vapor into the engine intake manifold MANVAP may be determined at a next step 224 as a product of mp and the measured fuel vapor concentration $\rho v$. To determine the fuel vapor mass flow rate into the engine cylinders, the engine intake manifold airflow dynamics must be taken into account, by modeling the dynamics and applying the model to MANVAP at a next step 226. In this embodiment, purge vapor transport dynamics are modeled using a first order lag filter model. However, higher order models and prediction for more than one event ahead may be provided through the exercise of ordinary skill in the art, to describe the purge vapor transport dynamics. In this embodiment, the first order lag filter model for the purge vapor transport dynamics can be written, for example, as a difference equation expressing the mass flow rate into the cylinder as a function of the mass flow rate purge fuel into the intake manifold, the manifold time constant $\tau$, and the described sampling time $\Delta t$, as follows:

$$MCYL(k)=e^{-\Delta t/\tau}*MCYL(k-1)+(1-e^{-\Delta/\tau})*MANVAP(k-1),$$

in which MCYL(k) is the current determined mass flow rate of vapor into cylinder and MCYL(k−1) is the most recent prior determined mass flow rate of vapor entering the cylinder, which may be initialized to a calibration value during standard controller initialization operations, and in which MANVAP(k−1) is the most recent prior determined mass flow rate of fuel vapor into the intake manifold.

The mass of purge fuel vapor trapped in the next consecutive engine cylinder at the intake valve closing is calculated at a next step 228 in steady state as follows:

$$CYLVAP=120*MCYL/(N*RPM).$$

This is converted to an equivalent injector pulse width PFest at a next step 230 using the slope $K_{inj}$ of a measured curve describing for a given fuel injector, the mass of fuel injected versus the injector pulse width, as follows:

$$PFest=CYLVAP/K_{inj}.$$

Figure 6:
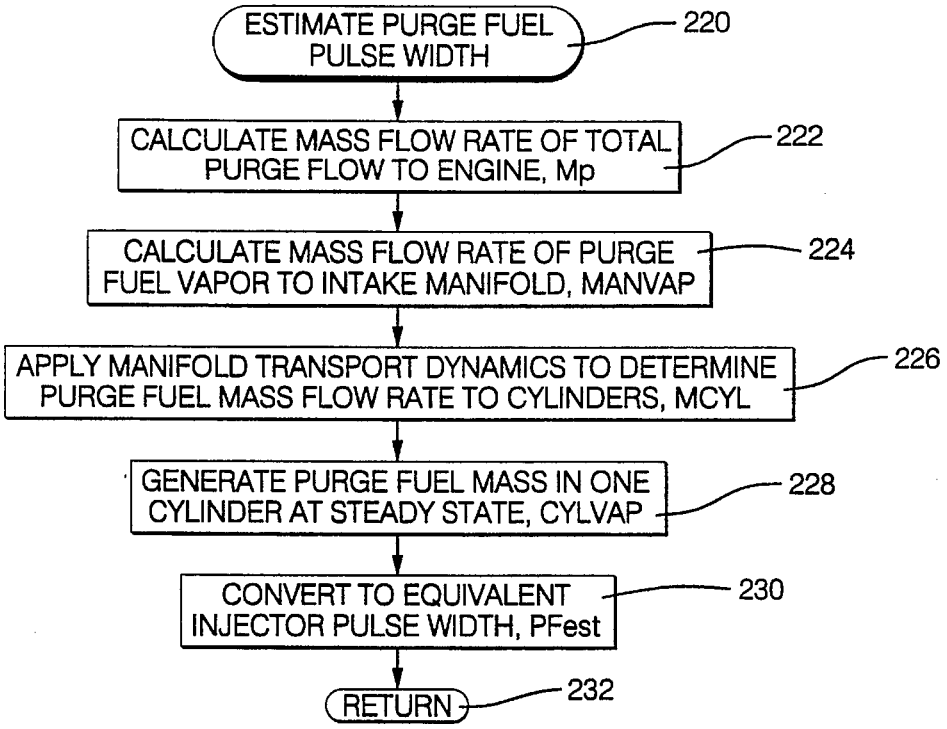
Figure 7:
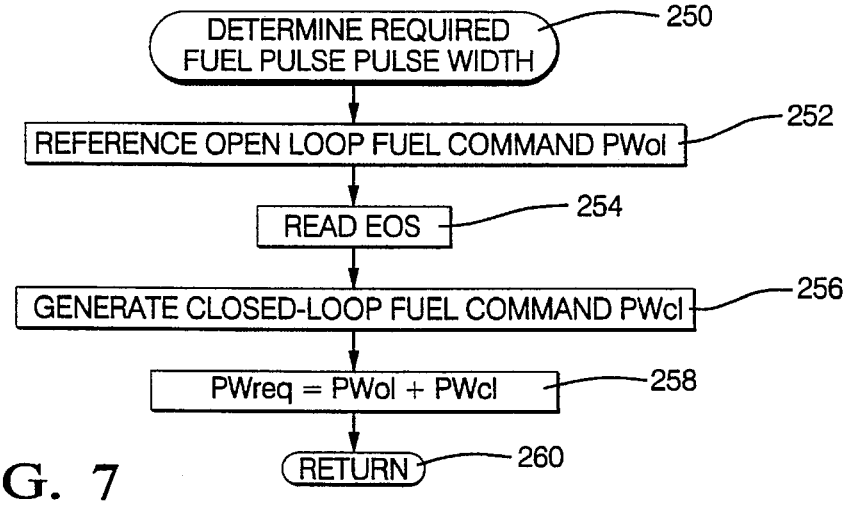

The fuel control operations then return, via step 232 of FIG. 6, to the operations of FIG. 3, at which a required fuel pulse width PWreq is next determined at a step 162, by carrying out the operations of FIG. 7, beginning at a step 250 and proceeding to a next step 252 to reference an open loop fuel command PWol. This command may be determined as a function of engine cylinder intake air rate and desired air/fuel ratio, such as the stoichiometric ratio. The engine cylinder intake air rate may be determined using signals RPM and MAP in a conventional speed density procedure, or may be determined using signal MAF from mass airflow sensor (not shown), adjusted to yield individual cylinder intake air rate information. PWol may then be determined by dividing the cylinder intake air rate by the desired air/fuel ratio, and then by dividing the result by the described slope Kinj.

The signal EOS is next read at a step 254 indicating engine exhaust gas oxygen content leading, through a procedure generally-understood in the art, to actual engine air/fuel ratio information. A closed-loop fuel command correction PWcl is next determined at a step 256 for correcting PWol in accord with feedback information on air/fuel ratio error as may be determined using the desired air/fuel ratio, the determined actual engine air/fuel ratio information through a conventional closed-loop fuel control process, such as is described in U.S. Pat. No. 4,625,698, assigned to the assignee of this invention. PWcl may have a negative or positive sign to provide for the appropriate adjustment to the open loop command, as is generally understood in the closed-loop air/fuel ratio control art.

A required fuel pulse width PWreq for supplying the necessary fuel quantity to the next active engine cylinder to provide for precise engine air/fuel ratio control in accord with engine emissions control and performance control standards, is next determined at a step 258 by combining PWol and PWcl. The routine then returns, via a next step 260, to the operations of FIG. 3, at which an injector command FPW for driving the fuel injector or injectors for the next active engine cylinder is calculated at a next step 164 by reducing the required fuel pulse width PWreq by PFest, the amount of fuel vapor already to be admitted to the cylinder in accord with the purge control operations. This provides, in accord with a critical aspect of this invention, that significant purge control activities may be carried out to maintain the canister so that rapid vapor generation conditions may not overwhelm the canister, as described. Substantial purge rates may therefore be provided and will not be compromised by rigid air/fuel ratio control requirements.

An injector offset Koff is then added to the determined FPW command and the resulting FPW command output at a step 166 to the fuel injector driver 54 for timed application to the next active fuel injector of the injectors 38 (FIG. 1). The command Pdc is also output to the purge valve driver 52 at the step 166, for timed application to the purge valve 22 (FIG. 1) so that the mass of purge fuel vapor being applied is mixed with the fuel mass represented by FPW for combining with intake air and for admission to the next active engine cylinder for combustion therein. As the purge mass entering the cylinder is known with precision through this invention, the purge rate may be maximized and directly integrated with cylinder fuel injection commands without compromising even rigid engine air/fuel ratio control requirements. The routine then returns, via a next step 168 to carry out any conventional control, diagnostic, and maintenance operations required for the current crank event (or time-based) interrupt, after which the controller proceeds to resume execution of the operations that were suspended to provide for servicing of the current crank event (or time-based) interrupt. The operations of FIGS. 3–7 will repeatedly be executed for successive of such interrupts to provide for continuing integrated engine fueling control in accord with this invention.

The preferred embodiment for explaining this invention is not to be taken as limiting or restricting this invention since many modifications may be made through the exercise of ordinary skill in the art without departing from this invention.

The embodiments of the invention in which a property or privilege is claimed are described as follows:

1. In an internal combustion engine having an intake manifold for receiving engine intake air and distributing the intake air to a plurality of engine cylinders, the engine having at least one fuel injector controlled to inject fuel from a fuel supply for combustion in the engine cylinders and in which a purge valve is controlled for controlling the mass flow rate of fuel vapor from a canister to the intake manifold for distribution to the engine cylinders and combustion therein, the canister for trapping fuel vapors released by the fuel supply, an integrated engine fuel control method for integrating fuel injector and purge valve control to provide a desirable engine fueling rate, comprising the steps of:

measuring purge vapor concentration;

measuring purge vapor pressure;

predicting the actual mass flow rate of cylinder purge vapor as a function of the measured purge vapor concentration and pressure;

generating a desired engine cylinder fuel mass;

reducing the desired engine cylinder fuel mass by the predicted actual mass of cylinder purge vapor;

calculating a fuel injector command as the fuel injector command that will provide for injection of the reduced desired engine cylinder fuel mass; and controlling at least one fuel injector in accord with the calculated fuel injector command.

2. The method of claim 1, wherein the predicting step further comprises the steps of:

calculating mass flow rate of intake manifold purge vapor as a function of the measured purge vapor concentration and pressure;

modeling purge vapor transport dynamics between the intake manifold and engine cylinders;

applying the calculated mass flow rate of intake manifold purge vapor to the purge vapor transport dynamics model to predict the actual mass flow rate of cylinder purge vapor.

3. The method of claim 1, further comprising the steps of:

generating a desired mass of purge vapor to an engine cylinder;

calculating purge vapor mass error as a difference between the generated desired mass and the predicted actual mass of cylinder purge vapor;

determining a purge valve command as a function of the calculated purge vapor mass error; and controlling the purge valve in accord with the determined purge valve command.

4. The method of claim 3, further comprising the steps of:

modeling purge vapor transport dynamics between the intake manifold and engine cylinders; and generating a feedforward purge vapor control command as a function of the modeled purge vapor transport dynamics;

and wherein the step of determining a purge valve command determines the purge valve command as a function of the feedforward purge vapor control command.

5. An engine control method for controlling engine air/fuel ratio by integrating control of the mass of fuel delivered by fuel injectors during each engine fuel injection event with control of a purge valve for purging fuel vapors trapped in a canister to an engine intake manifold, comprising the steps of:

measuring the concentration of fuel vapors being admitted to the intake manifold;

measuring the pressure of fuel vapors being admitted to the intake manifold;

calculating the actual mass flow rate of fuel vapors being admitted to the intake manifold as a predetermined function of the measured fuel vapor concentration and pressure;

for each engine cylinder having a corresponding fuel injector, (a) estimating the mass of fuel vapors being admitted to the engine cylinder as a function of the calculated actual mass flow rate of fuel vapors being admitted to the intake manifold, (b) determining a desired cylinder air/fuel ratio, (c) generating a desired fuel mass to be delivered to the engine cylinder as a function of the desired cylinder air/fuel ratio, (d) calculating a fuel injection mass as a difference between the desired fuel mass to be delivered to the engine cylinder and the estimated mass of fuel vapors being admitted to the engine cylinder, (e) determining a fuel injector command as a function of the calculated fuel injection mass, and (f) outputting the fuel injector command at a fuel injection event to deliver the calculated fuel injection mass for combustion in the engine cylinder.

6. The method of claim 5, further comprising the step of:

modeling purge vapor transport dynamics between the engine intake manifold and the engine cylinders;

and wherein the step of estimating the mass flow rate of fuel vapors being admitted to the engine cylinder estimates the mass flow rate of fuel vapors being admitted to the engine cylinders by applying the calculated actual mass flow rate of fuel vapors being admitted to the intake manifold to the modeled purge vapor transport dynamics.

7. The method of claim 5, further comprising the steps of:

providing a desired mass of purge vapor to individual engine cylinders;

determining a purge vapor mass error as a difference between the desired mass of purge vapor to individual engine cylinders and the estimated actual mass of fuel vapors being admitted to the engine cylinder;

generating a purge valve command as a function of the purge vapor mass error to controllably drive the error toward a minimum error; and applying the purge valve command to the purge valve to control mass of fuel vapor to the engine intake manifold.

8. The method of claim 7, further comprising the step of:

modeling the purge vapor transport dynamics between the engine intake manifold and the engine cylinders;

determining a feedforward purge valve command to provide the desired mass of purge vapor to engine cylinders by applying the desired mass of purge vapor to the purge vapor transport dynamics model; and adjusting the generated purge valve command by the determined feedforward purge valve command.

* * * * *